US007522105B1

(12) United States Patent
LaComb

(10) Patent No.: US 7,522,105 B1
(45) Date of Patent: Apr. 21, 2009

(54) ANTENNA USING A PHOTONIC BANDGAP STRUCTURE

(75) Inventor: Julie Anne LaComb, West Greenwich, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 83 days.

(21) Appl. No.: 11/489,815

(22) Filed: Jul. 17, 2006

(51) Int. Cl.
*H01Q 1/38* (2006.01)

(52) U.S. Cl. ..... 343/700 MS; 343/909; 343/829; 343/846

(58) Field of Classification Search ..... None
See application file for complete search history.

(56) References Cited

U.S. PATENT DOCUMENTS

| | | | | |
|---|---|---|---|---|
| 5,689,275 | A | 11/1997 | Moore et al. | |
| 5,923,225 | A * | 7/1999 | De Los Santos | 333/12 |
| 6,175,337 | B1 | 1/2001 | Jasper, Jr. et al. | |
| 6,177,909 | B1 | 1/2001 | Reid et al. | |
| 6,262,830 | B1 * | 7/2001 | Scalora | 359/248 |
| 6,469,682 | B1 | 10/2002 | de Maagt et al. | |
| 6,518,930 | B2 | 2/2003 | Itoh et al. | |
| 7,277,065 | B2 * | 10/2007 | Wu et al. | 343/909 |
| 2003/0142036 | A1 * | 7/2003 | Wilhelm et al. | 343/909 |
| 2005/0068233 | A1 * | 3/2005 | Tanaka et al. | 343/700 MS |
| 2005/0128148 | A1 * | 6/2005 | Anguera Pros et al. | 343/700 MS |
| 2006/0092079 | A1 * | 5/2006 | de Rochemont | 343/700 MS |
| 2007/0075903 | A1 * | 4/2007 | Matsugatani et al. | 343/700 MS |

* cited by examiner

*Primary Examiner*—Trinh V Dinh
(74) *Attorney, Agent, or Firm*—James M. Kasischke; Jean-Paul A. Nasser; Michael P. Stanley

(57) ABSTRACT

A microstrip patch antenna utilizes a microstrip patch antenna substrate formed of photonic bandgap material. One or more periodic patterns may be used therewith to produce multiple bandgaps into the photonic bandgap material. The periodic patterns may be produced by introducing periodic defects into the dielectric material substrate with drilled holes, slots, shorted vias, blind vias, buried vias, and/or plated or unplated patterns, such as plated patterns on the groundplane or on internally positioned surfaces, or on the surface adjacent the radiating elements. One or more radiating elements are used on an upper surface of said microstrip patch antenna substrate, and a groundplane is formed on a lower surface of said microstrip patch antenna substrate.

17 Claims, 1 Drawing Sheet

ANTENNA USING A PHOTONIC BANDGAP STRUCTURE

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to microstrip patch antennas and, more particularly, to a microstrip patch antenna with a multiband photonic bandgap structure.

(2) Description of the Prior Art

Microstrip patch antennas are very well known.

Microstrip patch antennas consist of thin, flat, printed circuit board antennas. Microstrip patch antennas are relatively inexpensive and easy to manufacture. The radiating elements of the antenna are conducting strips or patches printed on the upper surface of a dielectric substrate that is backed by a conducting ground plate or ground plane. Because such antennas have a very low profile and are mechanically rugged, they are often mounted on exposed exterior surfaces of aircraft and spacecraft, and surfaces such as the periscope of a submarine. They are often incorporated into mobile radio communications devices. These antennas tend to have low backlobes and are not prone to EMI and multipath effects. Microstrip patch antennas are usually employed at UHF and higher frequencies.

In a submarine environment, antenna size is often among the most restrictive of the design requirements. One disadvantage of microstrip patch antennas is that for lower frequencies a relatively large patch size is required. Another disadvantage of microstrip patch antennas is their narrow bandwidth. It has been found that bandwidth can be increased by increasing the substrate thickness. An increase in substrate thickness or dielectric constant can also decrease the resonant patch size. However, increased substrate thickness increases losses due to the substrate and surface waves thus reducing the antenna efficiency. Microstrip patch antennas on high dielectric constant substrates are highly inefficient radiators due to surface wave losses.

The use of photonic band-gap structures of antennas is a relatively new field. It is believed that the concept was first introduced in 1993 in a paper by R. E. Brown, C. D. Parker, and E. Yablon, titled "Radiation Properties of a Planar Antenna on a Photonic-Crystal Substrate." Much of the work has been on modeling and explaining the photonic bandgap material, rather than actual antenna patterns. Photonic bandgap structures are periodic dielectric structures that prevent propagation of electromagnetic waves in a certain frequency range, i.e, the frequency or wavelength range of the bandgap. Photonic bandgap structure reduces surface wave losses and can significantly increase microstrip patch antenna gain and frequency bandwidth.

The following U.S. patents describe various prior art systems that may be related to the above and/or other telemetry systems:

U.S. Pat. No. 6,518,930, issued Feb. 11, 2003, to Itoh et al, discloses a low-profile cavity-backed slot antenna, including a cavity substrate having a slot with a resonant frequency and a uniplanar compact photonic band-gap (UC-PBG) substrate, proximate to the cavity substrate and having a two-dimensional periodic metallic pattern on a dielectric slab and a ground plane, wherein the UC-PBG substrate behaves substantially as an open boundary at the resonant frequency of the slot. The slot antenna has reduced height while maintaining good performance.

U.S. Pat. No. 6,469,682, issued Oct. 22, 2002, to de Maagt et al, discloses a crystal structure with three-dimensional photonic band gap which comprises a pile of alternate series of layers of distinct dielectric materials having a first and a second determined dielectric constant values, wherein said layers have a constant determined thickness and said pile forms a substantially rectangular parallelepipedal block, and a plurality of parallel channels provided through said block along a direction orthogonal to the main faces of said layers. The channels are distributed according a two-dimensional lattice pattern and have a third determined dielectric constant value. The values for the dielectric constants as well as the relative geometric dimensions of said layers and said channels are selected so as to obtain said three-dimensional photonic band gap in a predetermined frequency range. The crystal structure is especially for use as an antenna substrate.

U.S. Pat. No. 6,177,909, issued Jan. 23, 2001, to Reid et al, discloses a reconfigurable photoconducting antenna that is created on a semiconductor substrate. At equilibrium, the semiconductor is semi-insulating, and therefore appears as a dielectric. Illuminating a region of the substrate results in the generation of free carriers in the substrate and allows the creation of a conductive region (semi-metallic) in the substrate. This conductive region functions as the radiating element of the antenna. Controlling the pattern of the illuminated region directly controls the pattern of the radiating antenna. By using a digital micromirror device to control the pattern of the light, a desired antenna design may be placed on the semiconductor substrate. The pattern can be dynamically adjusted simply by changing the position of the individual mirrors in the array.

The device operates through a standardized digital interface and can be switched between patterns in a period of approximately 20 microseconds. The pattern can therefore be readily and easily controlled through the use of a digital control system.

U.S. Pat. No. 6,175,337, issued Jan. 16, 2001, to Jasper, Jr. et al, discloses a high-gain, dielectric loaded, slotted waveguide antenna having a photonic bandgap, a high-impedance electromagnetic structure, in contact with the waveguide surface containing longitudinal slots, and a tailored dielectric material structure in contact with the outer surface of the photonic bandgap structure. The tailored dielectric structure at the inner most surface has the same effective dielectric constant of the waveguide material and the photonic bandgap structure. The effective dielectric constant is then incrementally or continuously reduced to have a dielectric constant close to that of the free-space value at the outer surface further distance from the waveguide array. The tailoring of the effective dielectric constant is achieved by layering a given number of slabs of different dielectric constants with sequentially reduced values, or by varying the chemical composition of the material, or by varying the density of the material imbedded with high dielectric constant particles.

U.S. Pat. No. 5,689,275, issued Nov. 18, 1997, to Moore et al, discloses a photonic bandgap antenna (PBA) that utilizes a periodic bandgap material (PBM), which is essentially a dielectric, to transmit, receive, or communicate electromagnetic radiation encoded with information. Further, a photonic bandgap transmission line (PBTL) can also be constructed with the PBM. Because the PBA and PBTL do not utilize metal, the PBA and PBTL can be used in harsh environments, such as those characterized by high temperature and/or high pressure, and can be easily built into a dielectric structure such as a building wall or roof. Further, the PBA and PBTL inhibit scattering by incident electromagnetic radiation at frequencies outside those electromagnetic frequencies in the bandgap range associated with the PBM.

The above cited prior art does not disclose a microstrip patch antenna with multiple band photonic bandgap structures. Consequently, those skilled in the art will appreciate the present invention that addresses this problem and other problems.

SUMMARY OF THE INVENTION

It is a general object of the present invention to provide an improved microstrip antenna.

Another object of the present invention is to produce wider bandgap material by either layering patterns or integrating patterns for substrates.

A feature of the present invention is a microstrip antenna with a multiple band photonic bandgap structure.

Another possible feature of the present invention is a dual-band photonic bandgap structure.

An advantage of the present invention is the possibility of providing a low loss microstrip antenna that utilizes a high dielectric substrate ($\in r$ approximately equal to 10 or greater) such as duroid, ceramic, or the like.

These and other objects, features, and advantages of the present invention will become apparent from the drawings, the descriptions given herein, and the appended claims. However, it will be understood that above listed objects and advantages of the invention are intended only as an aid in understanding certain aspects of the invention, are not intended to limit the invention in any way, and do not form a comprehensive or exclusive list of objects, features, and advantages.

Accordingly, the present invention provides a method for making a microstrip patch antenna. The method may comprise steps such as, for instance, utilizing dielectric material to form a multiband photonic bandgap structure for use as microstrip patch antenna substrate and forming one or more metallic strips on an upper surface of the microstrip patch antenna substrate to act as radiating elements. Other steps may comprise forming a groundplane on a lower surface of the microstrip patch antenna substrate. The method may further comprise utilizing dielectric material with a dielectric constant greater than or equal to 10.

The method may or may not further comprise integrating a metallic pattern into the groundplane. If used, the metallic pattern may be of various shapes such as a periodic double ring pattern, such as a periodic double ring circle pattern. Other steps may comprise forming a metallic pattern on the upper surface of the microstrip patch antenna substrate.

The method may or may not further comprise providing two or more layers of photonic bandgap material for use as microstrip patch antenna substrate. If used, the method may comprise providing that at least one of the two or more layers of photonic bandgap material is formed from dielectric material with a periodic pattern of openings formed therein. In another embodiment, the method may further comprise providing that at least one of the two or more layers of photonic bandgap material is formed from dielectric material with a periodic metallic pattern formed thereon.

The invention is utilized to create a microstrip patch antenna, which may comprise elements such as a microstrip patch antenna substrate formed of photonic bandgap material and a periodic pattern for the photonic bandgap material such that the periodic pattern is operable to produce-multiple bandgaps for the photonic bandgap material. Other elements may comprise one or more radiating elements on an upper surface of the microstrip patch antenna substrate, and a groundplane on a lower surface of the microstrip patch antenna substrate. The groundplane may or may not incorporate the periodic pattern as a metallic pattern. The metallic pattern may or may not comprise a periodic double ring pattern such as a periodic double ring circle pattern or a periodic double ring square pattern. The microstrip patch antenna may or may not comprise two or more layers of the photonic bandgap material for use as microstrip patch antenna substrate.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DESCRIPTION OF THE PREFERRED EMBODIMENT

Antenna gain is directly proportional to antenna size compared to the wavelength. One way to reduce the size of a microstrip patch antenna is to use a high dielectric material as the substrate. This changes the wavelength thus reducing the resonant length of the antenna. However, the higher the dielectric constant, the more energy is passed into the substrate rather than radiated, thus reducing the efficiency of the antenna.

As discussed hereinbefore, it has been found that a photonic bandgap structure can reduce the energy in the substrate. Photonic bandgap structures introduce periodic "defects" into the substrate much like a Bragg grating or crystal lattice introduces stop bands. Photonic bandgap structures are periodic dielectric structures that have a physical gap that is a bandgap that prevents propagation of electromagnetic waves of a particular frequency or wavelength within the bandgap. As used herein, a multiband photonic bandgap structure prevents propagation of electromagnetic waves for two or more frequency or wavelength ranges or bandgaps.

The present invention provides multiband photonic bandgap structures that may be used as the substrate for microstrip patch antennas to improve their performance. The multiband photonic bandgap structures may improve performance by reducing the size of the antenna and/or by increasing the bandwidth of the antenna. The present invention permits using high dielectric constant material ($\in r>10$) and/or thicker substrate layers to reduce antenna size without the losses normally associated therewith. Different types of substrate material may be used such as Duroid, ceramic, as well as more commonly used substrates such as Si or GaAs materials. The antenna of the present invention may be utilized at UHF frequencies such as GPS and L-band.

Figure 1:
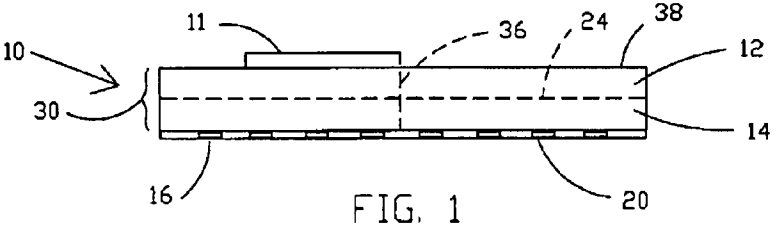
FIG. 1 is an elevational view of a microstrip antenna with multiple band photonic bandgap structure in accord with one possible embodiment of the present invention.

Referring now to the drawings and more particularly to FIG. 1, there is shown a side elevational view of microstrip patch antenna 10. The dimensions of FIG. 1 are not intended to be to scale. One or more radiating elements for microstrip patch antenna 10 are formed from metallic strips 11, which are provided as part of upper surface 38. Metallic strips 11 may be shaped in many ways such as rectangular, circular, triangular, U-shaped, L-shaped, notched square, fractal, E-shaped, or the like.

Electrical energy may be applied to metallic strips 11 on upper surface 38 in various ways. Examples include a coaxial feedline through the substrate, microstrip or stripline conduits plated onto upper surface 38, electromagnetic coupling, and the like. In the example shown in FIG. 1, coaxial feedline 36 through the substrate is provided. This coaxial feedline construction may be implemented using vias to provide coaxial feedline 36 through the photonic bandgap structures, as indicated in dielectric substrates 18 and 22 of FIG. 2 and FIG. 3.

Ground plane 16 is formed on the bottom surface of microstrip patch antenna 10, and may be a continuous metallic layer or may comprise or incorporate a metallic pattern therein, discussed in more detail hereinafter.

Dielectric substrate material, which is the photonic bandgap structure, is positioned between upper surface 38 and groundplane 16. This dielectric substrate material, or photonic bandgap material, may be formed in different ways, as discussed hereinafter. The dielectric substrate material may comprise multiple dielectric substrate layers as indicated by numerals 12 and 14, or may be a single dielectric substrate layer as indicated by numeral 30. Periodic defects may be introduced into the dielectric material substrate with drilled holes, slots, shorted vias, blind vias, buried vias, and/or plated or unplated patterns, such as plated patterns on the groundplane or on internally positioned surfaces.

Figure 2:
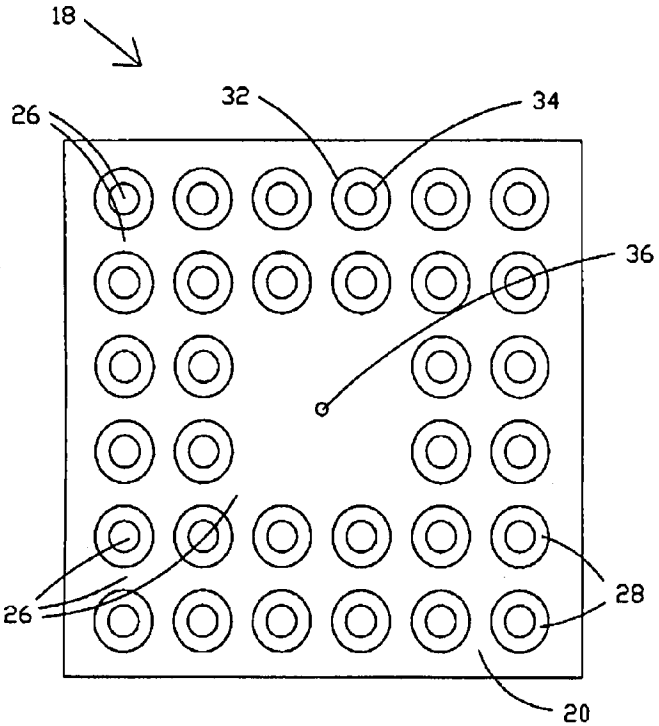
FIG. 2 is a-top or bottom view of a plated photonic bandgap structure or substrate in accord with one possible embodiment of the present invention.

In accord with one possible embodiment of the present invention, a single or monolithic layer 30 of dielectric substrate material may comprise one or more periodic plated patterns to create multiband photonic bandgap structures. In one possible preferred embodiment, the plated pattern may be introduced onto an upper or lower surface of a dielectric substrate. An example of such a pattern is shown in FIG. 2. In accord with another possible embodiment of the present invention, microstrip patch antenna 10 may comprise two or more different photonic bandgap structures, such as layers 12 and 14 as indicated in FIG. 1, wherein the dashed line indicates the possibility of a boundary or interface 24 between two different photonic bandgap structures, which may be created in various ways. In another possible embodiment, different plated patterns may be utilized internally at boundary or interface 24 and/or may be incorporated into groundplane 16. In another possible embodiment, plated patterns may be formed on upper surface 38 integral with and/or surrounding the microstrip patch antenna to prevent surface waves in one or more frequency ranges.

As a non-limiting example, referring now to FIG. 2, there is shown metallic pattern 20 for photonic bandgap material substrate 18. If desired, pattern 20 may be incorporated into groundplane 16. Metallic pattern 20 comprises a double ring pattern that is designed to create two frequency stop bands in the photonic bandgap material instead of only one. Metallic pattern 20 may be formed in any suitable way such as by etching, plating, or the like. The dielectric substrate material utilized to create photonic bandgap material substrate 18 may be a single layer of monolithic material and/or may also comprise a periodic pattern such as holes, slots, vias, or the like as discussed above. Metallic pattern 20 comprises inner and outer ring boundaries 32 and 34 to create two frequency stopbands for photonic bandgap material substrate 18. Thus, in accord with one possible embodiment wherein, metallic pattern 20 may comprise an etched pattern that is integrated into groundplane 16. Utilizing two or more stop bands in the dielectric substrate material for a microstrip patch antenna increases the stop bands for surface waves and/or substrate waves, thereby improving the operating range of the antenna.

In the non-limiting example of FIG. 2, the double circular ring pattern is formed as metallic pattern 20. In one embodiment, a metal layer forms metallic surfaces 26 that cover the entire area of metallic pattern 20 except at regions 28 where the substrate material is exposed. In this example, exposed substrate regions 28 are defined by inner and outer circular rings. This creates an outer circular ring boundary at 32 and an inner ring boundary at 34. This type of double ring circular pattern creates a dual bandgap structure that prevents propagation of electromagnetic waves of two frequency or wavelength ranges. If desired, such as for use as boundary or interface 24, metallic pattern 20 may also be inverted such that a metal surface is formed within regions 28 defined by outer circular ring boundary at 32 and an inner ring boundary at 34, and otherwise the surface is non-metallic.

Alternative metallic patterns may comprise other double ring patterns with other geometrical figures or polygons such as a double ring square pattern, double ring star pattern, double ring pentagon pattern, or the like, as compared to the double ring circle pattern shown in FIG. 2.

Accordingly, a multiband or dual band photonic bandgap structure could be created using metallic pattern 20 plated or etched or otherwise provided on the upper surface 38 or on groundplane 16. Metallic pattern may also be provided to form interface 24.

Figure 3:
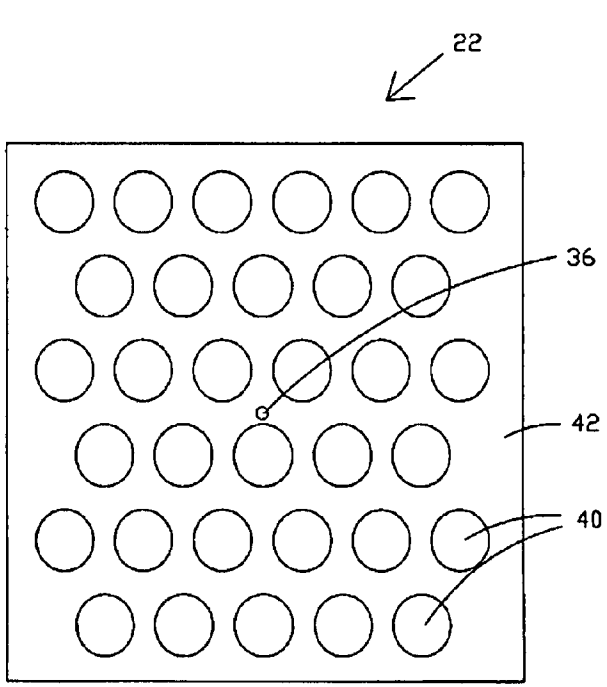
FIG. 3 is a-view from either the top or bottom of a substrate that is drilled in accord with one possible embodiment of the present invention.

FIG. 3 shows yet another way to develop a pattern for creating a periodic dielectric structure, such as by drilling or otherwise introducing "defects" such as holes 40 in a periodic pattern into dielectric substrate 22. Surface 42 may comprise uncovered dielectric material or may be metallic coated. While dielectric substrate 22 shows a particular periodic pattern of holes, many other periodic patterns may be formed therein. As well, more complex patterns may be formed such as circle or square rings, which may be drilled or otherwise formed therein, e.g., such as the ring shapes shown in FIG. 2.

A multiband photonic bandgap structure in accord with the present invention may also be formed by utilizing dielectric substrate 18, which comprises drilled holes in a first pattern as layer 12 shown in FIG. 1, and another dielectric substrate with drilled holes in a different pattern to form layer 14. For instance, layer 14 may comprise the pattern shown in FIG. 2 except the holes may be completely drilled out. The crystal or lattice or material "defects" may be introduced using different size holes and changing the spacing and arrangement thereof.

Multiband photonic bandgap structures may be formed in many ways utilizing the structures discussed above. For instance, layer 12 shown in FIG. 1 may comprise dielectric substrate 18 with metallic pattern 20 being positioned at boundary or interface 24. Layer 14 may comprise dielectric substrate 22. Alternatively, the two layers may be reversed. Alternatively, different metallic patterns may be utilized at boundary 24 and for groundplane 16. Alternatively, the dielectric material may comprise a pattern of holes or slots or rings and a metallic pattern, which may or may not be used in conjunction with other layers of dielectric material formed in any of the various ways discussed hereinbefore.

In summary, the present invention comprises a microstrip patch antenna which further utilizes a multiband photonic bandgap structure. The multiband photonic bandgap structure may be formed in many different ways as discussed above. For instance, metallic pattern 20 may be utilized as groundplane 16. Multiple layers of dielectric material may be utilized wherein each layer may or may not comprise a metallic pattern of many different types and/or may or may not comprise various holes formed therein and/or other patterns may be formed using other elements such as vias or the like which may be formed in a periodic pattern. The antenna may be especially suitable for use in submarine environments wherein smaller microstrip patch antennas may be of special use.

Many additional changes in the details, components, steps, algorithms, and organization of the system, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. A method for making a microstrip patch antenna, said method comprising:

utilizing dielectric material to form a multiband photonic bandgap structure for use as microstrip patch antenna substrate;

forming at least one radiating element on an upper surface of said microstrip patch antenna substrate, forming a ground plane on a lower surface of said microstrip patch antenna substrate, and integrating a metallic periodic pattern into said groundplane.

2. The method of claim 1 further comprising forming said multiband photonic bandgap structure by introducing periodic defects to said dielectric material, wherein said defects are physical gaps that function as bandgaps that prevent the propagation of electromagnetic waves of a particular frequency within the bandgap.

3. The method of claim 1 further comprising providing that said metallic pattern is a periodic double ring pattern.

4. The method of claim 3 further comprising providing that said metallic pattern is a periodic double ring circle pattern.

5. The method of claim 1 further comprising forming a metallic pattern on said upper surface of said microstrip patch antenna substrate.

6. The method of claim 1 further comprising providing a plurality of layers of photonic bandgap material for use as microstrip patch antenna substrate.

7. The method of claim 6 further comprising providing that at least one of said plurality of layers of photonic bandgap material is formed from dielectric material with a periodic pattern of openings formed therein.

8. The method of claim 6 further comprising providing that at least one of said plurality of layers of photonic bandgap material is formed from dielectric material with a periodic metallic pattern formed thereon.

9. The method of claim 1 further comprising utilizing dielectric material with a dielectric constant of at least 10.

10. A microstrip patch antenna, comprising:

a microstrip patch antenna substrate formed of photonic bandgap material;

a periodic pattern for said photonic bandgap material such that said periodic pattern is operable to produce multiple bandgaps for said photonic bandgap material;

at least one radiating element on an upper surface of said microstrip patch antenna substrate; and a ground plane on a lower surface of said microstrip patch antenna substrate wherein the microstrip patch antenna further comprises a metallic periodic pattern, which is integrated into said groundplane.

11. The microstrip of claim 10 wherein said metallic pattern comprises a periodic double ring pattern.

12. The microstrip patch antenna of claim 11 wherein said metallic pattern comprises a periodic double ring circle pattern.

13. The microstrip patch antenna of claim 10 further comprising a metallic pattern positioned on said upper surface of said microstrip patch antenna substrate.

14. The microstrip patch antenna of claim 10 further comprising a plurality of layers of said photonic bandgap material for use as microstrip patch antenna substrate.

15. The microstrip patch antenna of claim 14 wherein at least one of said plurality of layers of said photonic bandgap material comprises dielectric material with a periodic pattern of openings formed therein.

16. The microstrip patch antenna of claim 14 wherein at least one of said plurality of layers of photonic bandgap material comprises dielectric material with a periodic metallic pattern formed thereon.

17. The microstrip patch antenna of claim 10 wherein said photonic bandgap material comprises dielectric material with a dielectric constant of at least 10.

* * * * *